US007350875B2

(12) United States Patent
Onsori

(10) Patent No.: US 7,350,875 B2
(45) Date of Patent: Apr. 1, 2008

(54) UNDERGROUND MINING MACHINE

(75) Inventor: Siamak Onsori, Dortmund (DE)

(73) Assignee: DBT GmbH, Lunen (DE)

( * ) Notice: Subject to any disclaimer, the term of this patent is extended or adjusted under 35 U.S.C. 154(b) by 0 days.

(21) Appl. No.: 11/279,790

(22) Filed: Apr. 14, 2006

(65) Prior Publication Data

US 2006/0232122 A1 Oct. 19, 2006

(30) Foreign Application Priority Data

Apr. 15, 2005 (DE) ..... 10 2005 018 120

(51) Int. Cl.
*E21C 27/00* (2006.01)

(52) U.S. Cl. ..... 299/51; 299/73

(58) Field of Classification Search ..... 299/51, 299/52, 71, 73, 75, 77; 464/162
See application file for complete search history.

(56) References Cited

U.S. PATENT DOCUMENTS 1,536,986 A * 5/1925 Thiemer ..... 277/525
1,657,291 A * 1/1928 Weiland ..... 464/72
4,328,996 A 5/1982 Jahn

FOREIGN PATENT DOCUMENTS

DE 2357559 A1 * 5/1975
DE 2541838 A1 * 3/1977
DE 31 35 625 A1 4/1982
GB 2051931 A * 1/1981
GB 2 084 220 A 4/1982

* cited by examiner

*Primary Examiner*—John Kreck
(74) *Attorney, Agent, or Firm*—Cook, Alex, McFarron, Manzo, Cummings & Mehler, Ltd.

(57) ABSTRACT

The underground mining machine (10) according to the invention in known manner comprises a machine body (13) movable along a working face (11) and with at least one cutting and rolling unit (14) connected to the machine body by an extension arm (15) and drivable via a gear arrangement (17) mounted in the extension arm by a drive (16) disposed on the machine body. In order to make the drive system of the mining machine simpler, requiring less maintenance, and less subject to wear, according to the invention the gear arrangement comprises a compensating drive shaft (18) extending through the extension and coupled or adapted to be coupled by a first angular gear stage (19) to the drive on the machine body side and by a second angular gear stage (20) to the cutting and rolling unit on the cutting and rolling side.

20 Claims, 2 Drawing Sheets

UNDERGROUND MINING MACHINE

The present invention relates to an underground mining machine comprising a machine body movable along a working face and at least one cutting and rolling unit connected to the machine body by an extension arm and drivable via a gear arrangement in the extension arm by a drive disposed on the machine body.

A mining machine of this construction is proposed in, for example, DE 31 35 625 A1. In this previously proposed cutting and rolling loader, the gear arrangement in the extension arm is a multi-stage spur gear unit which, owing to the very heavy and sometimes intermittent loads, is subject to considerable sagging of the gearwheel shafts and consequently very non-uniform loading of the tooth flanks. The result is a considerable loss of capacity, quite possibly 20%, in the gear arrangement in the extension arm. Owing to the non-uniform loading, the transmission parts suffer very severe wear. An especial problem is that harmful peak loads on the roller head are frequently propagated through the entire gear device in the extension arm up to the driving motor and seriously affect transmission parts and also the drive, even after a short time in operation. It is therefore frequently necessary to replace the worn or damaged components. This replacement is especially complicated and time-consuming owing to the number of parts to change, e.g. bearings, gearwheels, seals or even the driving motor. During this frequently required work it is impossible to use the machine except by replacing the complete extension arm with a ready-fitted gear arrangement and in some cases also with the cutting and rolling unit. Replacement of sub-assemblies as complex as this requires expensive storage and is hardly practicable underground.

An aim of the present invention is to avoid these disadvantages and provide a mining machine according to the opening paragraph with a simple, low-maintenance wear-resistant drive system.

Accordingly the present invention is directed to a mining machine as described in the opening paragraph of the present specification, in which the gear arrangement comprises a compensating drive shaft extending through the extension arm and coupled or adapted to be coupled via a first angular gear stage to the drive on the machine body side and via a second angular gear stage to the cutting and rolling unit on the cutting and rolling side. "Compensating drive shaft" according to the invention means a shaft capable of compensating an axial and/or angular offset between the first angular gear stage on the input side and the second angular gear stage on the output side.

Apart therefore from the first angular gear stage on the machine-body side and the second angular gear stage on the cutting and rolling side, the gear arrangement substantially comprises only a torque-transmitting component, i.e. the compensating drive shaft, which considerably reduces the total cost of constructing the gear arrangement. Since the compensating drive shaft is capable of compensating axial and/or angular offset between the drive side and the driven side of the gear arrangement, it remains largely uninfluenced by peak stresses or the like which would be capable of penetrating through to it from the cutting and rolling unit during unprotected cutting operation. On the drive side, peak loads of this kind will at most be detectable only as peak torques, not in the form of sagging or the like of shafts or spindles and consequent non-uniform loading of the tooth flanks of the gearwheels.

Preferably the compensating drive shaft comprises at least one compensating coupling. The compensating coupling can comprise substantially a ball and socket joint, a cartilage joint, a universal joint or the like. It has been found advantageous if the compensating drive shaft is a universal shaft with two universal joints, capable of compensating any angular or axial offset existing or occurring between the drive side and the driven side.

Advantageously the cutting and rolling unit is connected to the second angular gear stage with interposition of a coupling, especially an overload coupling. This reliably prevents unacceptably heavy loads acting on the cutter roller during cutting operation from propagating over the overload coupling into the gear arrangement in the extension arm. In the event of such peak stresses, the coupling in the cutting and rolling head responds and briefly disconnects the cutter roller from its drive. The loads on the gear arrangement in the extension arm thus always remain below a fixed level defined by the response coefficient of the coupling.

Advantageously the compensating drive shaft in the extension arm is mounted on guide bearings in the neighbourhood of the angular gear stages and/or near the compensating coupling. The first angular gear stage and/or the second angular gear stage can substantially comprise a bevel gear of the construction for transmitting high torques and known and well-tried in a number of machines. Preferably the arrangement can be such that the first angular gear stage is disposed on a bearing block adjustably mounted in the extension arm. The advantage of this is that the position of the input shaft of the first bevel gear stage can be adjusted by adjusting the bearing block. It is thus possible especially to couple driving motors varying in construction, dimensions and/or capacity to the input of the first angular gear stage, so that the extension arm and its gear arrangement can be an insertable standard sub-group for various types of mining machines. Preferably the bearing block is adjustable substantially transversely of the longitudinal direction of the extension arm and lockable in various positions.

Advantageously also the compensating drive shaft is adjustable in length. This feature facilitates correct fitting of the transmission parts in the extension arm and also is a simple means of compensating changes in dimension due e.g. to thermal expansion in the gear unit. In an advantageous arrangement, the compensating drive shaft is divided substantially into two portions, wherein a first portion at the cutting and rolling end is movable in the extension arm between two bearings and pivotably connected by a compensating coupling to the second portion on the machine-body side, which is pivotably connected at its other end by a second compensating coupling to the first angular gear stage disposed on a bearing block, at least one of the portions being variable in length.

An example of an underground mining machine made in accordance with the present invention will now be described hereinbelow with reference to the accompanying drawings, in which.

Figure 3:
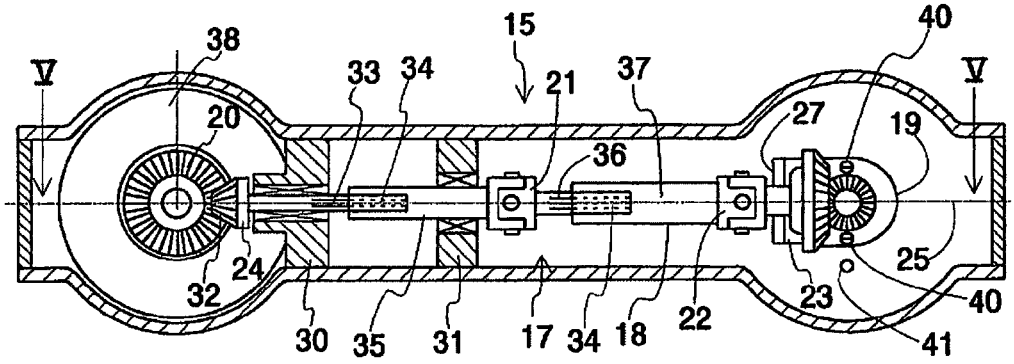
FIG. 3 is a longitudinal section through the extension arm of the cutting machine, along line III-III in FIG. 2.
Figure 4:
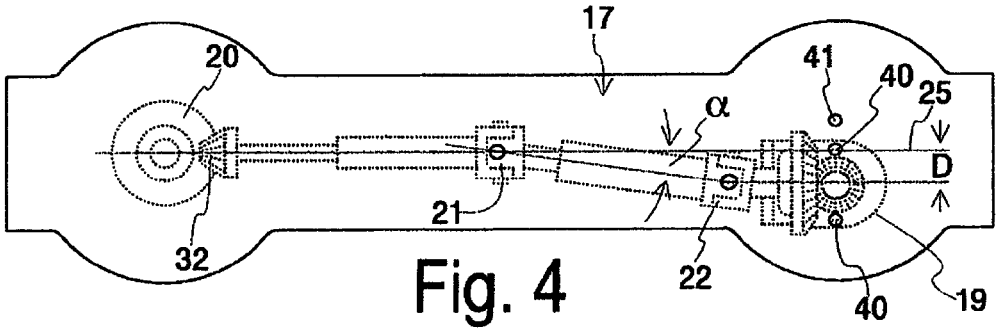
Figure 5:
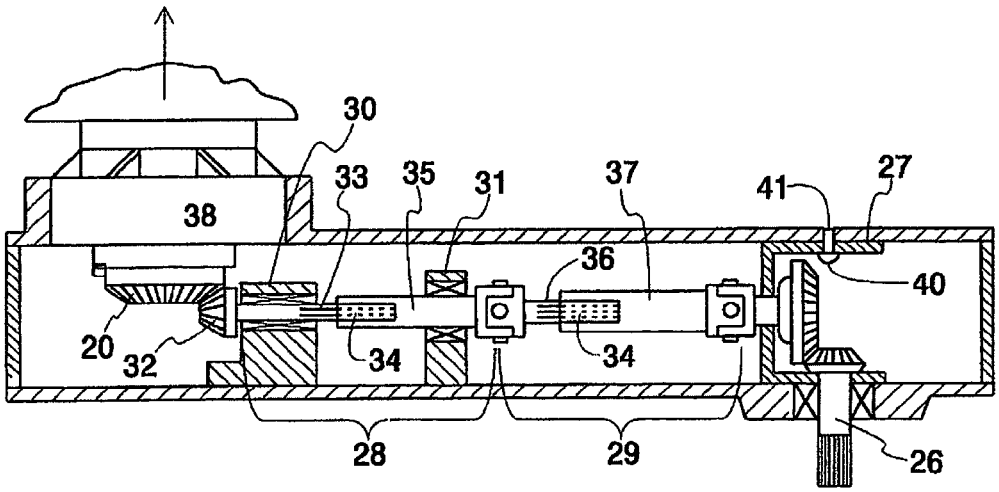

FIG. 4, which is based on FIG. 3, shows the extension arm with a differently oriented universal-joint shaft therein; and FIG. 5 is a section through FIG. 3 along a line V-V.

Figure 1:
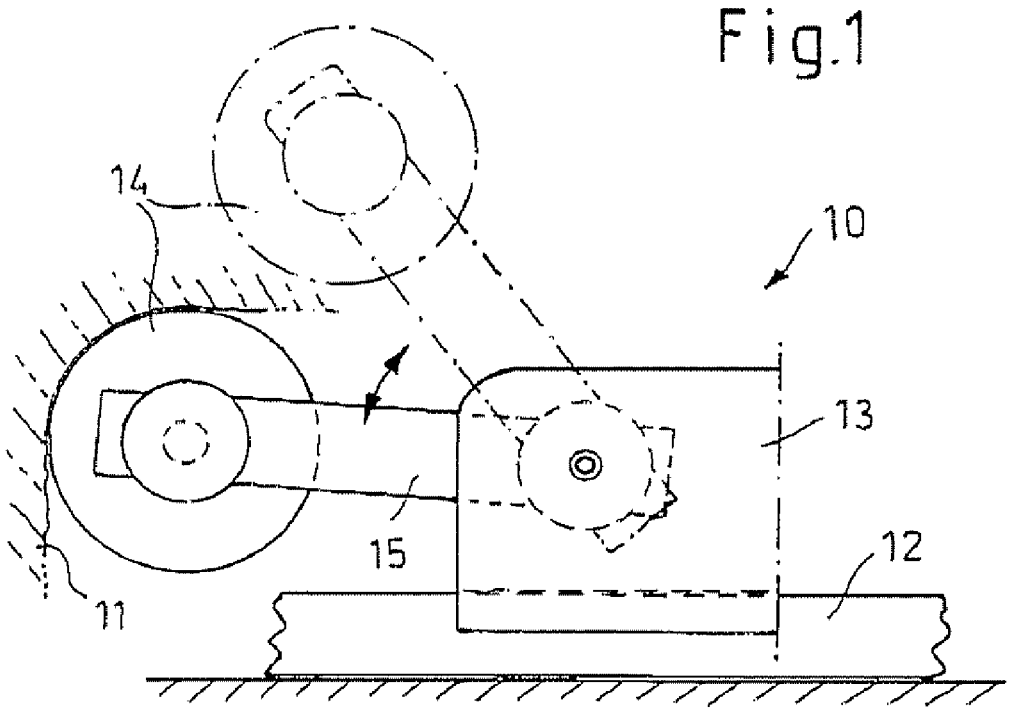
FIG. 1 is a simplified side view of part of a cutting machine according to the present invention.
Figure 2:
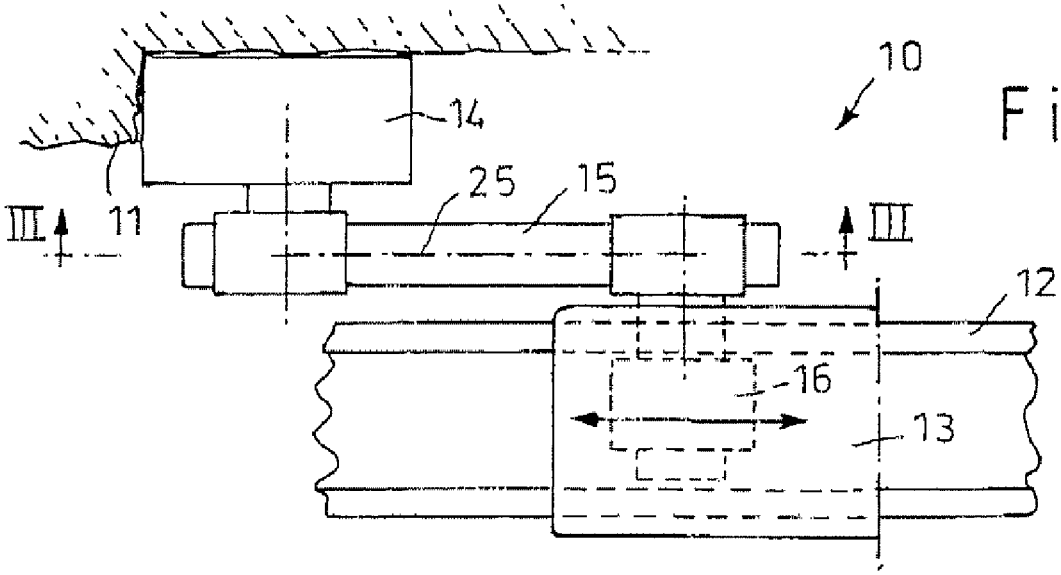
FIG. 2 is a plan view of the cutting machine shown in FIG. 1.

A cutting machine 10, shown partly and schematically only in FIG. 1, is for the underground mining of coal and has a machine body 13 movable along a conveyor 12 along a working face 11 and carrying a cutting and rolling unit 14 on one end (the left in the drawing). The other end of the machine body, only part of which is shown in the drawing, has a second cutting and rolling unit (not shown) as known in the case of cutting machines. The cutting and rolling unit 14 is connected to the machine body by an extension arm 15 which is of fixed length as shown in the drawings. The cutting and rolling unit is driven by a driving motor 16 disposed in the machine body (shown in chain lines only in FIG. 2). A gear arrangement 17 in the extension arm 15 transmits the driving force or motion from the driving motor 16 to the cutting and rolling unit 14.

The gear arrangement 17 according to the invention is shown in further detail in FIGS. 3 to 5. As can be seen, it comprises a compensating drive shaft 18 extending through the extension arm 15 and coupled to the driving motor 16 by a first angular gear stage or step 19 at the machine-body end of the extension arm. At the other or cutting-roller end of the extension arm, the gear arrangement has a second angular gear stage or step 20 via which the rotary motion of the compensating drive shaft 18 is converted into rotation of the rotatable cutting and rolling unit, which projects from the extension arm 15 towards the working face.

As can be seen, the compensating drive shaft 18 has two compensating couplings in the form of universal joints 21, 22 and can therefore compensate an angular offset $\alpha$ or an axial offset a between the machine or drive end 23 and the cutter-roller head or driven end 24 of the compensating drive shaft 18 as shown in FIG. 4. Such angular or axial offsets can accidentally occur as a result of high loads on the gear arrangements during operation or as a result of production and assembly tolerances or can be deliberately produced by using different drive units with different installation dimensions, which make it necessary to move the first angular gear stage in the extension arm at the machine-body or drive end. For example in FIG. 3 the position of the first angular gear stage 19 is substantially coaxial with the central axis 25 of the extension arm 15 in order to obtain a drive comprising a first type of driving motor, whereas in the arrangement of the compensating drive shaft 18 in FIG. 4 a second type of driving motor is used with a somewhat lower drive shaft, so that the input shaft 26 of the first angular gear stage 19 projects correspondingly lower down from the extension arm into the machine body.

To ensure that the first angular gear stage 19 is adjustable in this maimer, it is disposed on a bearing block 27 adjustably mounted in the extension arm 15 and securable in various positions inside the extension arm 15 by fastening elements 40 such as screws, locking pins or the like which fit into holes 41 formed in the bearing block 27 and the extension arm 15.

In order to compensate changes in the length of the compensating drive shaft 18 due e.g. to temperature or to changes in the position of the first angular gear stage 19, the compensating drive shaft 18 is variable in length. The arrangement is as follows: the compensating drive shaft 18 is divided into two portions 28, 29, each capable of compensating changes in length. The first portion 28 is disposed in the extension arm on the cutter-roller side and moved between two bearings 30, 31, wherein a first part-shaft 33 bearing a bevel or crown gear 32 of the second angular gear stage 20 engages via a multi-groove profile or spline 34 in a hollow second part 35 of the first compensating-shaft portion 28, so that the two part-shafts can be axially adjusted relative to one another. The first portion 28 of the compensating drive shaft 18 is connected to the second portion 29 via a universal joint 21 which is constructed the same as in the first portion 28, i.e. is likewise made up of two part-shafts 36, 37 co-rotatably but axially movably joined to one another by a multi-groove connection of spline 34. The bevel or crown gear of the first angular gear stage 20 is then connected by the second universal joint 22 to the machine-body end of the part 37 of the compensating shaft portion 29.

As shown most clearly in FIGS. 3 and 5, the cutting and rolling unit 14 is connected to the second angular gear stage 20 with interposition of an overload coupling 38 which responds and disconnects the cutting and rolling unit 14 from the gear arrangement 17 inside the extension arm 15 when very heavy loads arc acting on the cutting roller 14. In such cases the overload coupling comes into action so that the loads do not propagate into the gear arrangement in the extension arm 15 and thence into the drive 16 and possibly result in damage or premature wear of the drive arrangement.

The arrangement according to the invention as described provides a simple, reliable gear arrangement inside the extension arm, substantially insensitive to peak loads and easily adaptable in an advantageous manner to different installation conditions and drive units for the cutting machine, so that the extension arm and the gear arrangement therein form a standard component suitable for various cutting machines.

The invention claimed is:

1. An underground mining machine comprising a machine body movable along a working face and at least one cutting and rolling unit connected to the machine body via an extension arm of fixed length and drivable by a gear arrangement in the extension arm by a drive disposed on the machine body, in which the gear arrangement comprises an articulated compensating drive shaft extending through the extension arm and coupled or adapted to be coupled via a first angular gear stage to the drive on the machine body side and via a second angular gear stage to the cutting and rolling unit on the cutting and rolling side.

2. A mining machine according to claim 1, in which the articulated compensating drive shaft comprises at least one articulated compensating coupling.

3. A mining machine according to claim 2, in which the articulated compensating coupling comprises a ball and socket joint or a universal joint or the like.

4. A mining machine according to claim 2, characterised in that the articulated compensating drive shaft is a universal shaft with two universal joints.

5. A mining machine according to claim 1, in which the cutting and rolling unit (14) is connected to the second angular gear stage (20) with interposition of a coupling, particularly an overload coupling (38).

6. A miffing machine according to claim 1, in which the articulated compensating drive shaft in the extension arm is mounted on guide bearings in the neighborhood of the angular gear stages and/or near the articulated compensating coupling.

7. A mining machine according to claim 1, in which the first angular gear stage and/or the second angular gear stage comprise substantially a bevel gear.

8. A mining machine according to claim 1, in which the first angular gear stage is disposed on a bearing block adjustably mounted in the extension arm.

9. A mining machine according to claim 8, in which the bearing block is adjustable substantially transversely of the longitudinal direction of the extension arm and is lockable in various positions.

10. A mining machine according to claim 1, in which the articulated compensating drive shaft is variable in length.

11. An underground mining machine comprising a machine body movable along a working face and at least one cutting and rolling unit connected to the machine body via an extension arm and drivable by a gear arrangement in the extension arm and by a drive disposed on the machine body, in which the gear arrangement comprises a compensating drive shaft extending though the extension arm and coupled or adapted to be coupled via a first angular gear stage to the drive on the machine body side and via a second angular gear stage to the cutting and rolling unit on the cutting and rolling side, the compensating drive shaft being divided substantially into two portions, wherein a first portion at the cutter rolling end is movable between two bearings in the extension arm and is pivotably connected via a compensating coupling to the second portion at the machine-body end and the other end of the portion is pivotably connected via a second compensating coupling to the first angular gear stage mounted on a bearing block, at least one of the portions being variable in length.

12. A mining machine according to claim 11, in which the compensating drive shaft comprises at least one compensating coupling.

13. A mining machine according to claim 11, in which the compensating coupling comprises a ball and socket joint or a universal joint or the like.

14. A mining machine according to claim 11, characterized in that the compensating drive shaft is a universal shaft with two universal joints.

15. A mining machine according to claim 11, in which the cutting and rolling unit is connected to the second angular gear stage with the inner position of a coupling, particularly an overload coupling.

16. A mining machine according to claim 11, in which the compensating drive in the extension arm is mounted on guide bearings in the neighborhood of the angular gear stages and/or near the compensating coupling.

17. A mining machine according to claim 11, in which the first angular gear stage and/or the second angular gear stage comprised substantially a bevel gear.

18. A mining machine according to claim 11, in which the first angular gear stage is disposed on a bearing block adjustably mounted in the extension arm.

19. A mining machine according to claim 18, in which the bearing block is adjustable substantially traversely of the longitudinal direction of the extension arm and is lockable in various positions.

20. A mining machine according to claim 11, in which the compensating drive shaft is variable in length.

* * * * *